US011019857B2

(12) United States Patent
Wu et al.

(10) Patent No.: US 11,019,857 B2
(45) Date of Patent: Jun. 1, 2021

(54) REFRIGERATING CLOTHES

(71) Applicant: WUYI UNIVERSITY, Jiangmen (CN)

(72) Inventors: Min Wu, Jiangmen (CN); Guangwei Chen, Jiangmen (CN)

(73) Assignee: WUYI UNIVERSITY, Jiangmen (CN)

( * ) Notice: Subject to any disclaimer, the term of this patent is extended or adjusted under 35 U.S.C. 154(b) by 112 days.

(21) Appl. No.: 16/389,871

(22) Filed: Apr. 19, 2019

(65) Prior Publication Data

US 2020/0297049 A1 Sep. 24, 2020

(30) Foreign Application Priority Data

Mar. 20, 2019 (CN) ..... 201910212690.X

(51) Int. Cl.
*A41D 13/005* (2006.01)
*A62B 17/00* (2006.01)

(52) U.S. Cl.
CPC ..... *A41D 13/0053* (2013.01); *A62B 17/005* (2013.01); *F25D 2400/26* (2013.01)

(58) Field of Classification Search
CPC ..... A41D 13/0053; A62B 17/005; F25D 2400/26; F25B 15/04; F25B 15/00; F25B 27/007; F25B 9/006; F25B 30/04; F25B 37/00; F25B 43/046
See application file for complete search history.

(56) References Cited

U.S. PATENT DOCUMENTS 2,221,551 A * 11/1940 Sprengel ..... F25B 37/00 62/141
2018/0266712 A1* 9/2018 Plourde ..... F24D 19/1051

FOREIGN PATENT DOCUMENTS

JP 10072707 A * 3/1998 ..... A41D 13/0053

OTHER PUBLICATIONS

Machine translation of JP 1072707 (Year: 1998).*

* cited by examiner

*Primary Examiner* — Joseph F Trpisovsky
(74) *Attorney, Agent, or Firm* — Kolitch Romano LLP

(57) ABSTRACT

Refrigerating clothes may include a clothes body and a refrigerating mechanism having a working medium capable of changing between gas and liquid. The refrigerating mechanism includes a radiating surface and a refrigerating surface, between which the working medium circulates. The refrigerating surface is abutted against the clothes, and the radiating surface is arranged at one side far away from the refrigerating surface. The radiating surface absorbs thermal radiation from sunlight and provides energy for the working medium, the working medium absorbs heat on the refrigerating surface to realize cooling, and continuously circulates in the refrigerating mechanism without need for frequent replacement.

13 Claims, 3 Drawing Sheets

REFRIGERATING CLOTHES

FIELD

The present disclosure relates to the field of clothing, and more particularly, to refrigerating clothes.

INTRODUCTION

At present, with the further advancement of urbanization, outdoor high heat operations are spread in almost all industries of industrial production in a large number of productions and lives, such as iron and steel smelting, paper making, plastic production, cement production, etc. In addition, traffic police and volunteers who must work outdoors in the city in hot summer, soldiers on guard and field duty, and construction site workers who work in the open air are all directly exposed to high temperature and heat damage. Refrigerating or cooling clothes appearing in the market to cool down the workers, have ice stored in the clothes that is melted and transported to a plastic pipeline in the clothes by a water pump, thus achieving a refrigerating effect. However, the ice needs to be continuously supplemented as a cold source, and the environmental protection and economy are insufficient.

SUMMARY

The present disclosure is intended to solve one of the technical problems above in related art to some extent. Therefore, the disclosure provides an economical and environment-friendly refrigerating or cooling clothing.

The technical solution used to solve the technical problem thereof according to the present disclosure is described as follows.

Refrigerating clothes (i.e., clothing having a built-in refrigeration or cooling feature) comprises a clothes body and a refrigerating means, wherein a working medium capable of changing between gas and liquid is arranged in the refrigerating means. The refrigerating means comprises a radiating surface and a refrigerating surface. The working medium circulates between the radiating surface and the refrigerating surface. The refrigerating surface is abutted against the clothes, and the radiating surface is arranged at one side far away from the refrigerating surface.

Beneficial effects: the radiating surface absorbs thermal radiation from sunlight and provides energy for the working medium. The working medium changes between gas and liquid in the refrigerating means and absorbs heat on the refrigerating surface to realize cooling. The working medium also continuously circulates in the refrigerating means without needing to be frequently replaced, which is economical and environment-friendly.

The refrigerating means comprises a generator, a condenser, an evaporator, and an absorber. The generator, the condenser, the evaporator, and the absorber are sequentially communicated to form a loop, and the working medium flows in the loop. The working medium circulates among the generator, the condenser, the evaporator, and the absorber, and takes away the heat from the clothes through the steps of gasification, liquefaction, depressurization, and (again) gasification.

Further, the working medium may comprise a mixture of hydrogen, ammonia, and water. The ammonia circulates in the refrigerating system for cooling, and meanwhile, the water is used as a solvent to recover the ammonia, so that the whole refrigerating system is continuously circulated. The addition of the hydrogen can reduce a pressure of the ammonia.

Further, a first heat exchanger may be arranged between the absorber and the generator, the first heat exchanger comprising a first pipeline and a second pipeline. The two ends of the first pipeline are respectively connected with a top end of the absorber and a top end of the generator. The two ends of the second pipeline are respectively connected with a bottom end of the absorber and a bottom end of the generator. The working medium is recovered in the absorber and heat exchange is performed through the first heat exchanger, so that a temperature of the working medium is maintained. A certain temperature is maintained to improve an evaporation rate when re-entering the generator.

Further, a second heat exchanger may be arranged between the evaporator and the absorber, the second heat exchanger comprising a third pipeline and a fourth pipeline. The two ends of the third pipeline are respectively connected with a top end of the absorber and a top end of the evaporator. The two ends of the fourth pipeline are respectively connected with a bottom end of the absorber and a bottom end of the evaporator. Warm hydrogen gas is cooled by the heat exchanger to avoid affecting the refrigerating effect of the evaporator.

Further, the condenser may be arranged above the generator, and the condenser may be obliquely and downwardly arranged towards the evaporator. Liquefied liquid ammonia in the condenser is thereby conveniently led into the evaporator under gravity.

Further, the condenser may comprise an air-cooled condenser.

Further, the evaporator may be arranged in the refrigerating surface, and the generator in the radiating surface. The evaporator reduces a temperature of the refrigerating surface and transmits the temperature to the clothes. The radiating surface receives sunlight and absorbs the heat of the sunlight to promote the evaporation of the working medium.

Features, functions, and advantages may be achieved independently in various embodiments of the present disclosure, or may be combined in yet other embodiments, further details of which can be seen with reference to the following description and drawings.

DETAILED DESCRIPTION

Various aspects and examples of refrigerated/refrigerating clothing are described below and illustrated in the associated drawings. Unless otherwise specified, an article of refrigerating clothing in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

Figure 1:
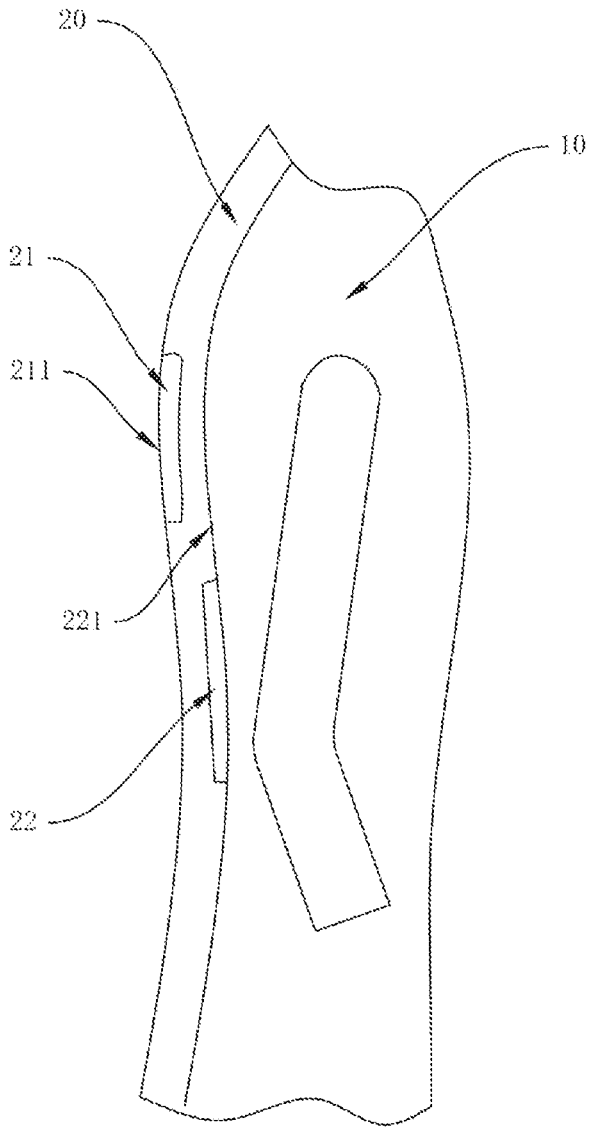
FIG. 1 is a structure diagram according to an embodiment of the present disclosure.

Turning now to the drawings, with reference to FIG. 1, refrigerating clothes comprise a clothes body 10 and a refrigerating means 20, wherein a working medium capable of changing between gas and liquid is arranged in the refrigerating means 20. The refrigerating means 20 comprises a radiating surface 211 and a refrigerating surface 221. The working medium circulates between the radiating surface 211 and the refrigerating surface 221. The refrigerating surface 221 is abutted against the clothes 10, and the radiating surface 211 is arranged at one side away from the refrigerating surface 221.

Preferably, the working medium comprises a mixture of hydrogen, ammonia, and water. The ammonia circulates in the refrigerating system for cooling, and meanwhile, the water is used as a solvent to recover the ammonia. The whole refrigerating system is continuously circulated. The addition of hydrogen can reduce a pressure of the ammonia. In the following embodiments, any suitable working medium may be utilized, with the mixture of hydrogen, ammonia, and water being an example.

The radiating surface 211 absorbs thermal radiation from sunlight and provides energy for the working medium. The working medium changes between gas and liquid in the refrigerating means 20 and absorbs heat on the refrigerating surface 221 to realize cooling. The working medium continuously circulates in the refrigerating means 20 without needing to be frequently replaced, which is economical and environment-friendly.

In some embodiments, the evaporator 22 is arranged in the refrigerating surface 221, and the generator 21 is arranged in the radiating surface 211. The evaporator 22 reduces a temperature of the refrigerating surface 221 and transmits the temperature to the clothes 10. The radiating surface 211 receives sunlight and absorbs the heat of the sunlight to promote the evaporation of the working medium.

Figure 2:
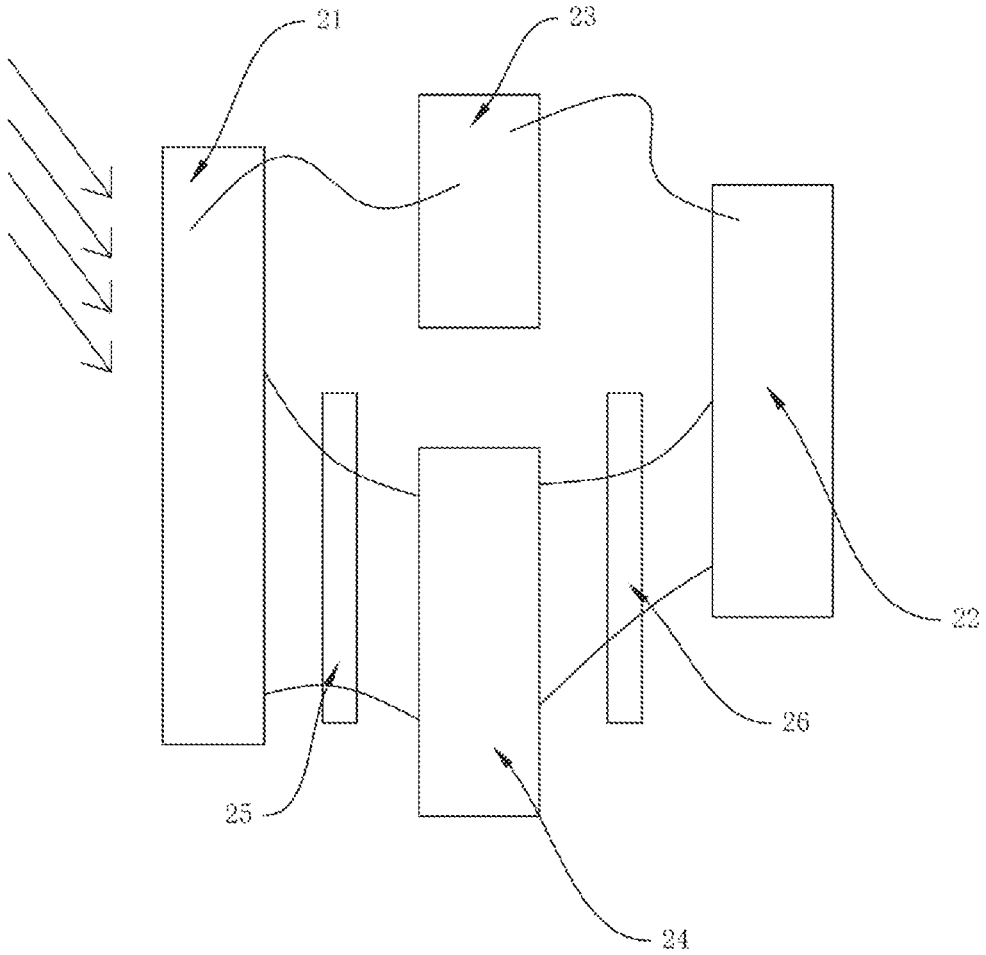
FIG. 2 is a structure diagram of a refrigerating means according to an embodiment of the present disclosure.
Figure 3:
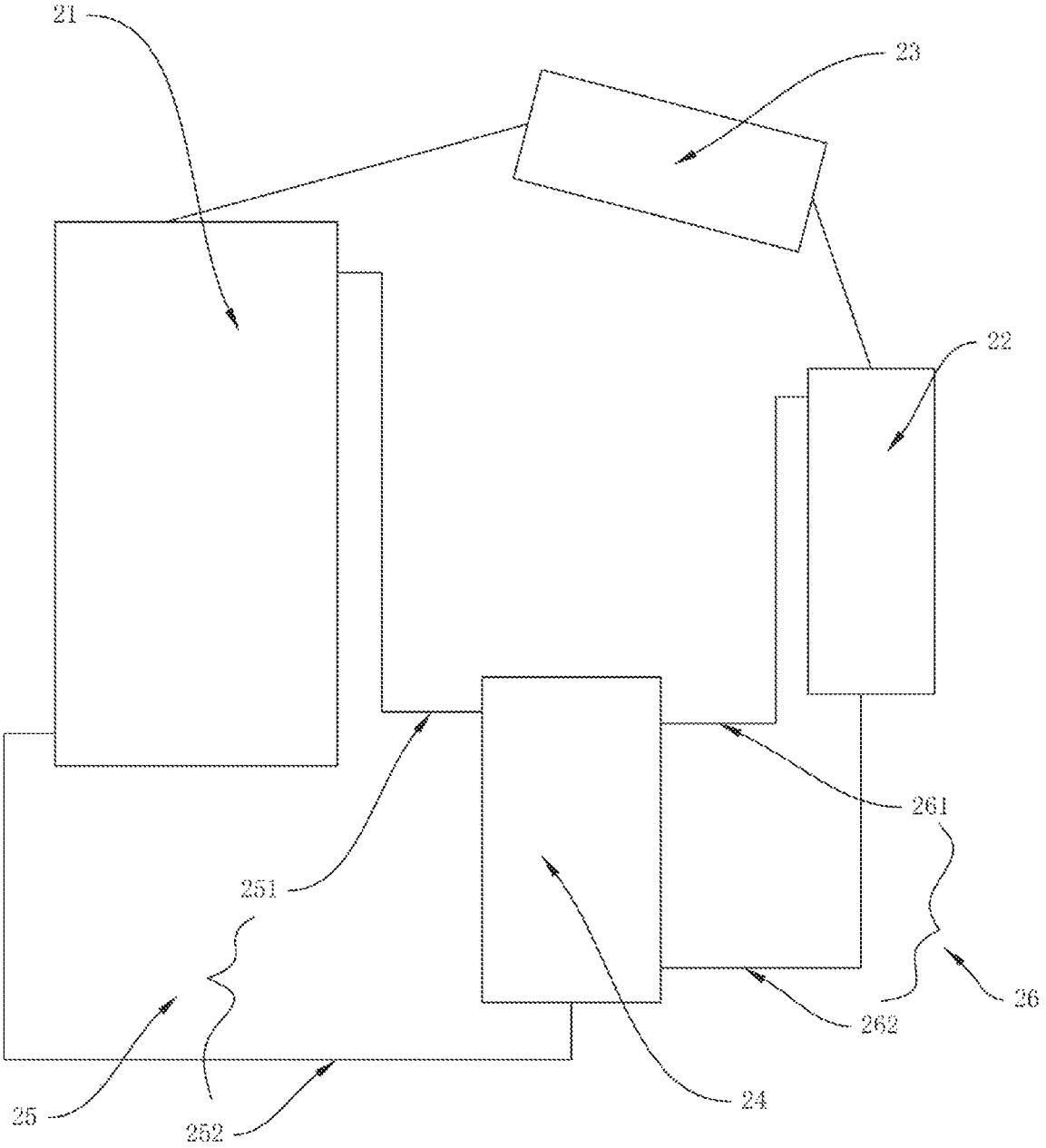
FIG. 3 is another structure diagram of the refrigerating means according to an embodiment of the present disclosure.

In some embodiments, with reference to FIG. 2 and FIG. 3, the refrigerating means 20 comprises a generator 21, a condenser 23, an evaporator 22, and an absorber 24. The generator 21, the condenser 23, the evaporator 22, and the absorber 24 are sequentially communicated to form a loop, and the working medium flows in the loop.

The generator 21 receives the thermal radiation of sunlight (arrows in FIG. 2 indicate an irradiation direction of the sunlight) to distill the ammonia water in the generator 21. The boiling point of the ammonia is lower than that of the water. Accordingly, a large amount of ammonia gas is released from the ammonia water and enters the condenser 23. Preferably, the condenser 23 comprises an air-cooled condenser which is provided with a fin to enlarge a contact area between the condenser 23 and the air. The ammonia gas is cooled to fully liquefy the ammonia gas and enters the evaporator 22. The condenser 23 is arranged obliquely and downwardly towards the evaporator 22. Liquefied liquid ammonia in the condenser 23 is conveniently led into the evaporator 22 under gravity. After the liquid ammonia enters the evaporator 22, the hydrogen gas is inputted from the absorber 24 to reduce an intensity of pressure in the evaporator 22, and reduce a boiling point of substances in the evaporator 22, thus evaporating the liquid ammonia to absorb heat, and taking away the heat of the clothes 10 through the refrigerating surface 221, so as to complete refrigeration. The hydrogen gas forms a cycle in the evaporator 22 and the absorber 24.

In some embodiments, a first heat exchanger 25 is arranged between the absorber 24 and the generator 21. The first heat exchanger 25 comprises a first pipeline 251 and a second pipeline 252. The two ends of the first pipeline 251 are respectively connected with a top end of the absorber 24 and a top end of the generator 21, and the two ends of the second pipeline 252 are respectively connected with a bottom end of the absorber 24 and a bottom end of the generator 21.

The working medium is recovered in the absorber 24 and heat exchange is performed through the first heat exchanger 25, so that a temperature of the working medium is maintained, and a certain temperature is maintained to improve an evaporation rate when re-entering the generator 21.

With reference to FIG. 3, during use, a concentration of the solution in the generator 21 is decreased during a distillation process of concentrated ammonia water. The solution with a high density remains at the bottom. The dilute ammonia water with a low density rises and enters the absorber 24 via the first pipe 251 according to a siphon principle. Meanwhile, the dilute ammonia water entering the absorber 24 preheats the solution in the absorber 24, and the preheated solution is mixed with the liquid ammonia from the evaporator 22 to form concentrated ammonia water. This is then re-inputted into the generator 21 through the second pipe 252 to form a cycle.

In some embodiments, a second heat exchanger 26 is arranged between the evaporator 22 and the absorber 24. The second heat exchanger 26 comprises a third pipeline 261 and a fourth pipeline 262. The two ends of the third pipeline 261 are respectively connected with a top end of the absorber 24 and a top end of the evaporator 22. The two ends of the fourth pipeline 262 are respectively connected with a bottom end of the absorber 24 and a bottom end of the evaporator 22. Warm hydrogen gas is cooled by the heat exchanger to avoid affecting the refrigerating effect of the evaporator 22.

The injection of the hydrogen into the refrigerating means 20 is intended to reduce the intensity of pressure of the ammonia gas at the evaporator 22, thus reducing the boiling point and promoting the liquefaction of the ammonia gas to absorb heat. The hydrogen gas enters the evaporator 22 along with the liquid ammonia from the fourth pipeline 262, but the hydrogen gas is insoluble in water. The hydrogen gas re-enters the evaporator 22 via the third pipeline 261, in the path of the evaporator 22—the absorber 24—the evaporator 22. The hydrogen gas is cooled in the third pipeline 261 to reduce the temperature, so that the temperature of the hydrogen gas entering the evaporator 22 is reduced, to avoid affecting the refrigerating effect.

In some embodiments, the condenser 23 is arranged above the generator 21, and the condenser 23 is obliquely and downwardly arranged towards the evaporator 22. Liquefied liquid ammonia in the condenser 23 is conveniently led into the evaporator 22 under gravity.

Additional aspects and features of refrigerating clothes, are presented below without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. Refrigerating clothes, comprising a clothes body and a refrigerating means having a working medium capable of changing in gas and liquid, wherein the refrigerating means comprises a radiating surface and a refrigerating surface, the working medium circulates between the radiating surface and the refrigerating surface, the refrigerating surface is abutted against the clothes, and the radiating surface is arranged at one side far away from the refrigerating surface.

A1. The refrigerating clothes according to A0, wherein: the refrigerating means comprises a generator, a condenser, an evaporator and an absorber; the generator, the condenser, the evaporator and the absorber are sequentially communicated to form a loop; and the working medium flows in the loop.

A2. The refrigerating clothes according to A1, wherein: a first heat exchanger is arranged between the absorber and the generator; the first heat exchanger comprises a first pipeline and a second pipeline; the two ends of the first pipeline are respectively connected with a top end of the absorber and a top end of the generator; and the two ends of the second pipeline are respectively connected with a bottom end of the absorber and a bottom end of the generator.

A3. The refrigerating clothes according to A1 or A2, wherein: a second heat exchanger is arranged between the evaporator and the absorber; the second heat exchanger comprises a third pipeline and a fourth pipeline; the two ends of the third pipeline are respectively connected with a top end of the absorber and a top end of the evaporator; and the two ends of the fourth pipeline are respectively connected with a bottom end of the absorber and a bottom end of the evaporator.

A4. The refrigerating clothes according to any one of A1 through A3, wherein the condenser is arranged above the generator, and the condenser is obliquely and downwardly arranged towards the evaporator.

A5. The refrigerating clothes according to any one of A1 through A4, wherein the condenser comprises an air-cooled condenser.

A6. The refrigerating clothes according to any one of A1 through A5, wherein the evaporator is arranged in the refrigerating surface, and the generator is arranged in the radiating surface.

A7. The refrigerating clothes according to any one of A0 through A6, wherein the working medium comprises a mixture of hydrogen, ammonia and water.

A8. The refrigerating clothes according to claim 3, wherein the working medium comprises a mixture of hydrogen, ammonia and water.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An article of refrigerating clothing, comprising a clothes body; and a refrigerating means having a working medium capable of changing between gas and liquid;

wherein:

the refrigerating means comprises a radiating surface and a refrigerating surface, the working medium circulates between the radiating surface and the refrigerating surface, the refrigerating surface is abutted against the clothes body, and the radiating surface is arranged at one side away from the refrigerating surface;

wherein the refrigerating means comprises a generator, a condenser, an evaporator, and an absorber; wherein the generator, the condenser, the evaporator, and the absorber are sequentially communicated to form a loop; wherein the working medium flows in the loop; wherein the working medium comprises a mixture of hydrogen, ammonia and water; and wherein two pipelines are arranged between the evaporator and the absorber; ends of one pipeline are respectively connected with a top end of the absorber and a top end of the evaporator; and ends of another pipeline are respectively connected with a bottom end of the absorber and a bottom end of the evaporator and wherein the hydrogen circulates in a path of the evaporator, the one pipeline, the absorber, the another pipeline and the evaporator.

2. The article of refrigerating clothing according to claim 1, wherein:

a first pipeline and a second pipeline are arranged between the absorber and the generator;

ends of the first pipeline are respectively connected with a top end of the absorber and a top end of the generator; and ends of the second pipeline are respectively connected with a bottom end of the absorber and a bottom end of the generator.

3. The article of refrigerating clothing according to claim 2, wherein the condenser is arranged above the generator, and the condenser is obliquely and downwardly arranged towards the evaporator.

4. The article of refrigerating clothing according to claim 3, wherein the condenser comprises an air-cooled condenser.

5. The article of refrigerating clothing according to claim 2, wherein the evaporator is arranged in the refrigerating surface, and the generator is arranged in the radiating surface.

6. The article of refrigerating clothing according to claim 1, wherein the condenser is arranged above the generator, and the condenser is obliquely and downwardly arranged towards the evaporator.

7. The article of refrigerating clothing according to claim 6, wherein the condenser comprises an air-cooled condenser.

8. The article of refrigerating clothing according to claim 1, wherein the evaporator is arranged in the refrigerating surface, and the generator is arranged in the radiating surface.

9. An article of refrigerating clothing, comprising a clothes body; and a refrigerating means having a working medium capable of changing between gas and liquid;

wherein the refrigerating means comprises a radiating surface and a refrigerating surface, and the working medium circulates between the radiating surface and the refrigerating surface, wherein the refrigerating surface is abutted against the clothes body, wherein the radiating surface is arranged at one side away from and opposite the refrigerating surface and is configured to absorb thermal radiation from sunlight and provide energy for the working medium, wherein the radiating surface is an outside surface of the refrigerating means when the refrigerating means is put on the clothes body and wherein a generator is arranged in the radiating surface.

10. The article of refrigerating clothing according to claim 9, wherein the refrigerating means comprises the generator, a condenser, an evaporator, and an absorber, wherein the generator, the condenser, the evaporator, and the absorber are sequentially communicated to form a loop; and wherein the working medium flows in the loop, and the working medium comprises a mixture of hydrogen, ammonia, and water.

11. The article of refrigerating clothing according to claim 10, wherein the evaporator is arranged in the refrigerating surface.

12. The article of refrigerating clothing according to claim 11, wherein a first pipeline and a second pipeline are arranged between the absorber and the generator; ends of the first pipeline are respectively connected with a top end of the absorber and a top end of the generator; and ends of the second pipeline are respectively connected with a bottom end of the absorber and a bottom end of the generator.

13. The article of refrigerating clothing according to claim 12, wherein a third pipeline and a fourth pipeline are arranged between the evaporator and the absorber; ends of the third pipeline are respectively connected with a top end of the absorber and a top end of the evaporator; and ends of the fourth pipeline are respectively connected with a bottom end of the absorber and a bottom end of the evaporator, and wherein the hydrogen circulates in a loop of the evaporator, the third pipeline, the absorber, the fourth pipeline and the evaporator such that the hydrogen is cooled in the third pipeline to reduce temperature to avoid affecting a refrigerating effect.

* * * * *